United States Patent [19]

Freisinger et al.

[11] Patent Number: 4,616,843

[45] Date of Patent: Oct. 14, 1986

[54] RELEASE SKI BINDING

[75] Inventors: Henry Freisinger, Vienna; Franz Luschnig, Traiskirchen; Karl Stritzl; Johann Zotter, both of Vienna, all of Austria

[73] Assignee: TMC Corporation, Baar, Switzerland

[21] Appl. No.: 683,745

[22] Filed: Dec. 19, 1984

[30] Foreign Application Priority Data

Dec. 19, 1983 [AT] Austria ..... 4418/83

[51] Int. Cl.[4] ..... A63C 9/081; A63C 9/084

[52] U.S. Cl. ..... 280/618; 280/628; 280/632

[58] Field of Search ..... 280/613, 618, 620, 631, 280/632, 617, 636, 633

[56] References Cited

U.S. PATENT DOCUMENTS

| | | | |
|---|---|---|---|
| 4,033,603 | 7/1974 | Horn | 280/618 |
| 4,130,297 | 12/1978 | Horn | 280/613 |
| 4,230,338 | 10/1980 | Weigl et al. | 280/618 |
| 4,251,090 | 2/1981 | Weigl | 280/618 |
| 4,266,806 | 5/1981 | Weigl et al. | 280/618 |
| 4,277,083 | 7/1981 | Himmetsberger et al. | 280/633 |

FOREIGN PATENT DOCUMENTS

| | | | |
|---|---|---|---|
| 2324078 | 5/1973 | Fed. Rep. of Germany | 280/617 |

*Primary Examiner*—John J. Love
*Assistant Examiner*—Karin L. Ferriter
*Attorney, Agent, or Firm*—Flynn, Thiel, Boutell & Tanis

[57] ABSTRACT

A release ski binding comprising a sole plate having thereon a rear jaw for a ski shoe, a central part thereof being pivotal relative to the ski about a vertically upright axis and about a transversely extending axis. The sole plate is held in a skiing position by an elastic holding mechanism on the ski. The holding mechanism is responsive to a swivel movement occurring between the sole plate and the ski and upon reaching of a predetermined angle of traverse effects an opening of a release lock on the rear jaw. The sole plate consists of two parts, of which the one part is pivotally supported for movement about a vertical axis of a sleeve and the other part is hingedly connected to the first part through the transverse axis.

13 Claims, 9 Drawing Figures

RELEASE SKI BINDING

FIELD OF THE INVENTION

The invention relates to a release ski binding having embodied therein a sole plate.

BACKGROUND OF THE INVENTION

Such release ski bindings are described in German Pat. No. 25 33 337 (corresponds to U.S. Pat. No. 4,033,603). In these known ski bindings, the spring of the holding mechanism acts through a piston onto a generally mushroom-shaped holding member swingably supported to all sides in the housing of the holding mechanism. The stem of the mushroom-shaped holding member is received in a recess of a fitting member fixed to the ski. In these known ski bindings, the ski shoe is held at the tip thereof by means of a rigid bar fixed to the sole plate. In the case of a fall of the skier to the rear, the ski shoe is therefore released with difficulty.

An embodiment of a similar ski binding is described in German Offenlegungsschrift No. 23 24 078, however, the structure of this binding is complicated and the release mechanism is housed in the space between the base plate and the sole plate. Further, special sealing measures are required to prevent the penetration of snow and dirt into the housing parts. Furthermore, the mounting of this binding onto the ski is complicated and expensive.

The purpose of the invention is to overcome the disadvantages of the known designs and to provide a release ski binding in which the vertical axis which, in the known first embodiment, must be relatively long in order to permit a pivotal movement of the sole plate about the transverse axle, is to be short, so that the ski shoe has a smaller distance from the upper side of the ski than in the known construction.

The purpose is primarily attained by providing a sole plate composed of two parts pivotally connected to each other. This construction has furthermore the advantage that no relative movement between the shoe sole and the sole plate takes place until the release point of the binding is reached. Consequently also no friction takes place between the mentioned parts and no influence on the release force in the inventive binding occurs. Furthermore, there exists the possibility of providing for all sizes of ski shoes in a conventional manner a constant distance between the working surfaces of the two jaws.

BRIEF DESCRIPTION OF THE DRAWINGS

Exemplary embodiments of the subject matter of the invention are illustrated in the accompanying drawings, in which:

FIG. 3 illustrates the rear jaw in a central longitudinal cross section;

FIG. 4 is a cross-sectional view taken along the line IV—IV of FIG. 3;

FIG. 5 is an enlarged top view of a detail of FIG. 2;

FIG. 6 illustrates the rear jaw in the open position corresponding with FIG. 3;

FIG. 7 illustrates a detail of FIG. 1; and

DETAILED DESCRIPTION

Figure 1:
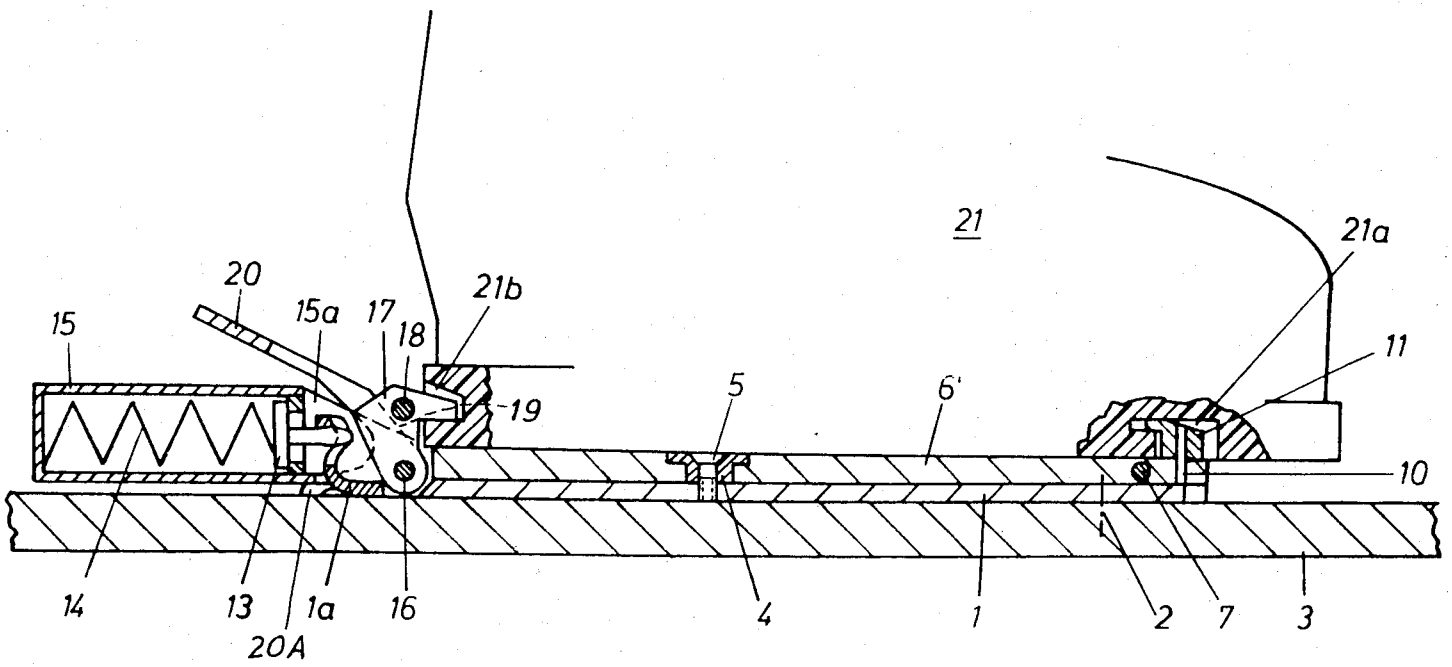
FIG. 1 is a cross-sectional view of the binding taken along the line I—I of FIG. 2.

The inventive release ski binding has a base plate 1 which, adjacent the front end thereof, is secured by means of screws 2 to the upper side of the ski 3. A vertically upright axle defined by a sleeve 4 is secured to the base plate by means of a screw 5 and the axis thereof is an extension of the axis of the lower leg of the skier. The sleeve 4 is made of a low friction material. A part 6' of a sole plate 6 has the sleeve 4 mounted thereon. The part 6' carries adjacent the front end thereof a transversely extending axle 7 on which is supported a second part 6'' of the sole plate 6. A ski shoe 21 is clamped on the sole plate 6 and can thus pivot both about the axis of the sleeve 4 and about the transverse axis of the axle 7.

Figure 2:
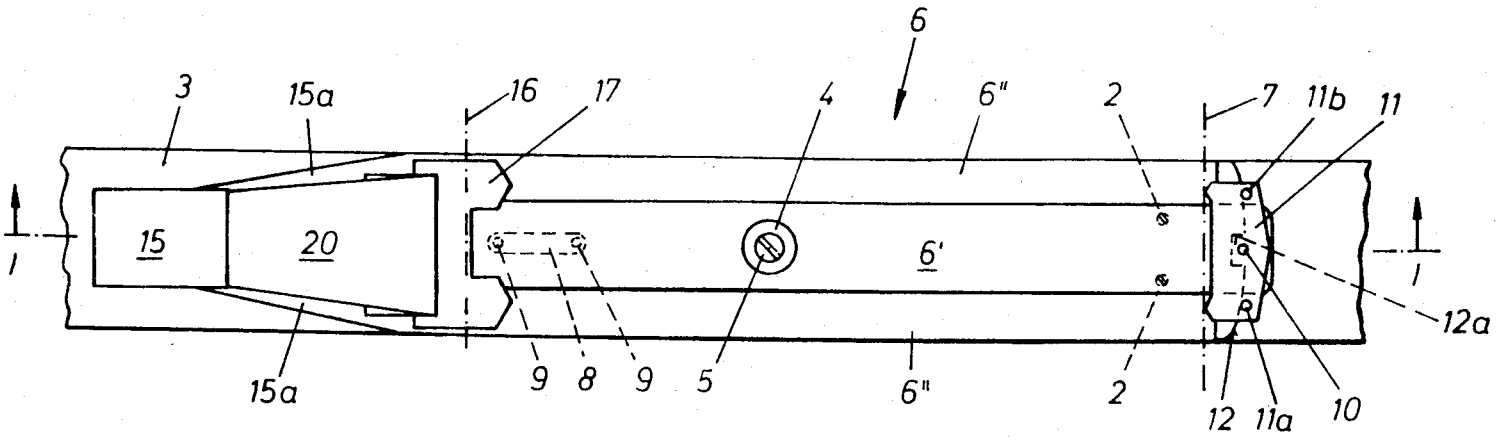
FIG. 2 is a top view thereof.
Figures 4, 5:
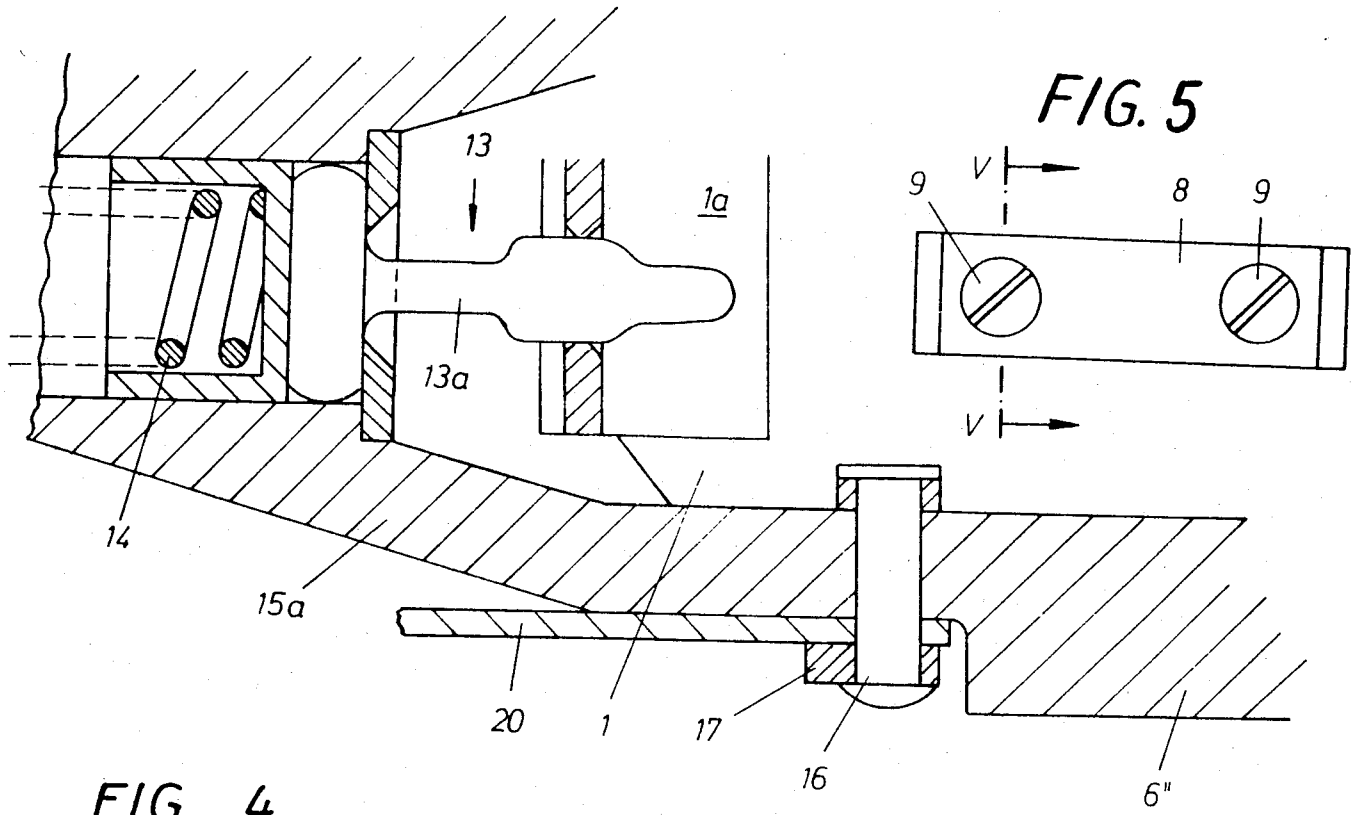
Figure 5A:
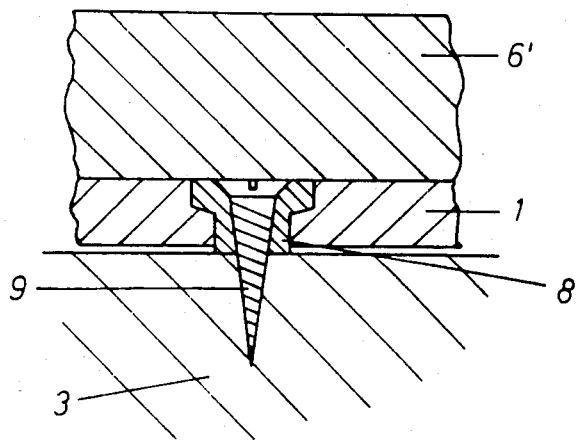
FIG. 5A is a cross-sectional view taken along the line V—V of FIG. 5.
Figure 7:
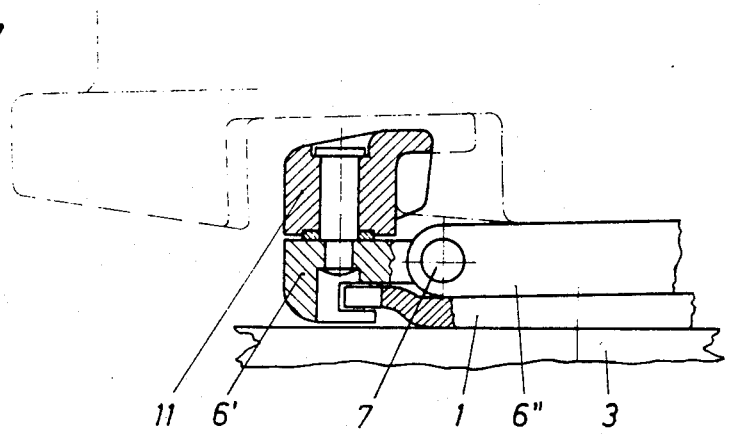

An elongate T-shaped guide bar 8 (see FIGS. 2, 5A and 5) is secured to the ski 3 by means of screws 9 and extends parallel to the longitudinal axis of the ski and is received in an elongate T-shaped groove in the bottom of the base plate 1. The guide bar 8 is used to compensate for change in length as they occur during a bending of the ski relative to the base plate 1.

A bolt 10 is mounted on the part 6' adjacent the front end thereof. The bolt 10 extends approximately vertically relative to the upper side of the ski. A front jaw 11 is pivotally supported for movement about the axis of the bolt 10. The front jaw 11 is received in a recess **21*a* in the bottom surface of the sole of the ski show 21. Laterally and equidistantly spaced from the longtudinal center line of the binding are two control bolts 11*a* and 11*b* or control rollers on the front jaw 11, which rollers are guided on a cam surface 12 formed by the transversely extending front end surface of the base plate. However, the cam surface 12 is not continuous, but has in its central region a trapezoidal-shaped or rectangular-shaped recess 12*a* therein, which in the case of a fall of the skier permits a release of the ski shoe 21 from the front jaw 11**.

Figure 3:
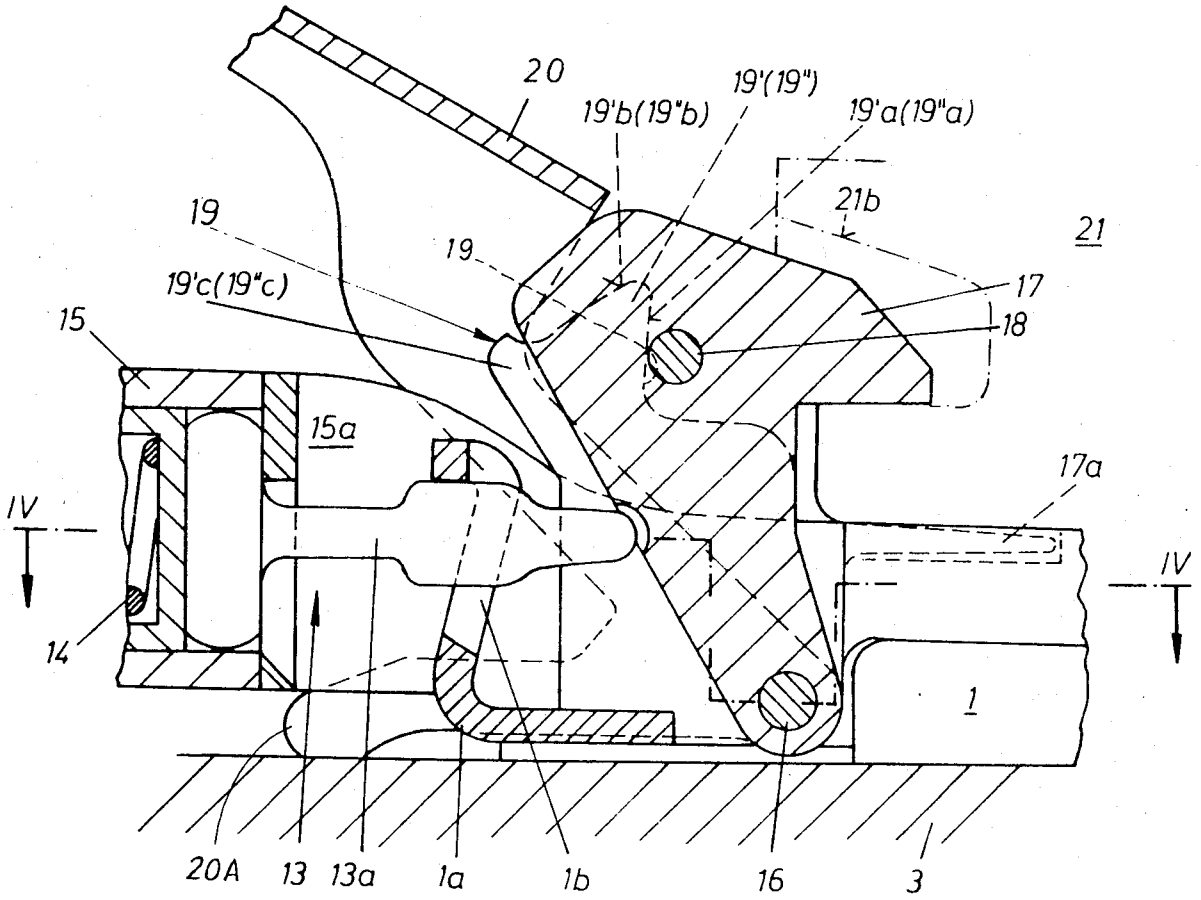
FIGS. 3 to 7 illustrates in an enlarged scale details of the first embodiment, namely.

At the rear end of the base plate 1, an approximately Z-shaped holding part **1*a* is provided. The holding part 1*a* has a recess 1*b* (FIG. 3) therein, bordered by control surfaces. The holding part 1*a* is preferably manufactured of a material which is harder compared with the base plate 1, for example, steel plate. The stem portion 13*a* of generally mushroom-shaped holding member 13 extends into recess 1*b*. Further, the enlarged head on the holding member is loaded by a pressure spring 14 the initial tension of which is adjustable. The adjusting mechanism for adjusting the initial tension of the spring is of a conventional design and therefore not illustrated and described in detail. The pressure spring 14 is enclosed in a spring housing 15, which by means of bifurcated attachment arrangement 15*a*, is connected to the end of the second part 6''** or is constructed in one piece therewith.

The second part 6'' has two axially spaced and coaxial axles 16 adjacent the rear thereof. A rear jaw 17 is pivotally supported on the two axles 16. The rear jaw 17 has a stepping spur **17*a* (FIG. 3) and has otherwise a generally hookedshaped design. The hook extends into a recess 21*b* at the rear end of the ski shoe 21. Furthermore, the rear jaw 17 has a control bolt 18** or a control roller, with which it can be guided along a cam surface 19 generally designated in FIG. 1. The cam surface 19 is secured to the part 6' and projects upwardly therefrom. Further, the cam surface 19 consists of a portion which forms two paths 19' and 19" arranged symmetrically with respect to the longitudinal center plane of the binding. Each cam surface path 19' or 19" has a part 19'*a* or 19"*a* which extends upwardly in an arc about the transverse axle 7 and a part 19'*b* or 19"*b* which extends at an acute angle with respect to the part 19'*a* or 19"*a* rearwardly and downwardly in an arc about the axle 16 when the rear jaw 17 is in the open position. The release point of the binding is provided between the two part 19'*a* and 19'*b* or 19"*a* and 19"*b*. The part 19'*b* or 19"*b* ends in a projection 19'*c* or 19"*c*, which limits the angle of traverse of the rear jaw 17. The rear jaw 17 is under the influence of a torsion spring (not illustrated in the drawings) which urges the jaw 17 into the open position.

A release lever 20 is provided and is hinged to the axles 16. The lever 20 is generally bifurcated and functions like a toggle lever, the lever arm part thereof 20A resting on the upper side of the ski 3 under the influence of a not illustrated torsion spring.

During skiing, the release ski binding is in the position illustrated in FIG. 1 and the rear jaw 17 is under the influence of the pressure spring 14 in its position holding the ski shoe.

If a voluntary release of the binding is to be started, then the release lever 20 is swung counterclockwise against the force of the pressure spring 14 and its lever arm 20A slides along the upper side of the ski. Through this swinging movement the axles 16 and with them the rear jaw 17 are lifted up. As soon as the control bolt 18 reaches the end of the part 19'*a* or 19"*a* of the cam 19' or 19" and thus the release point, the control bolt 18 moves onto the part 19'*b* or 19"*b* on which it slides until it reaches the projection 19'*c* or 19"*c*. The rear jaw 17 is thus opened.

During an automatic release, the plate 6" and with it the rear jaw 17 are pivoted about the transverse axle 7 by a force which is applied by the ski shoe to effect a lifting of the control bolt 18 up along the part 19'*a* or 19"*a*, until the release point is reached. The mushroom-shaped holding member 13 is simultaneously pivoted to cause the pressure spring 14 to become compressed. The control bolt 18 thereafter slides on the part 19'*b* or 19"*b*, namely, until the projection 19'*c* or 19"*c*, functioning as a stop, is reached. In this position of the rear jaw 17, the ski shoe 21 can easily leave the binding.

In the case of a twisting fall of the skier, the part 6' is pivoted about the axis of the sleeve 4. The pressure spring 14 is thereby slightly compressed by the inclined position of the mushroomshaped holding member 13. As soon as the front jaw 11 has exceeded a pregiven angle of traverse, the one of the two control bolts 11*a* or 11*b* moves into the recess 12*a* of the base plate 1, which causes the front jaw 11 to be able to swivel and thus to be able to release the ski shoe 21.

Figure 8:
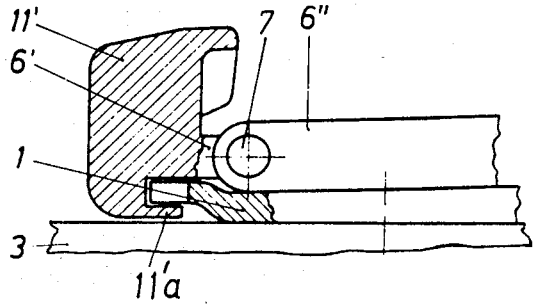
FIG. 8 shows a detail of a second embodiment.
Figure 6:
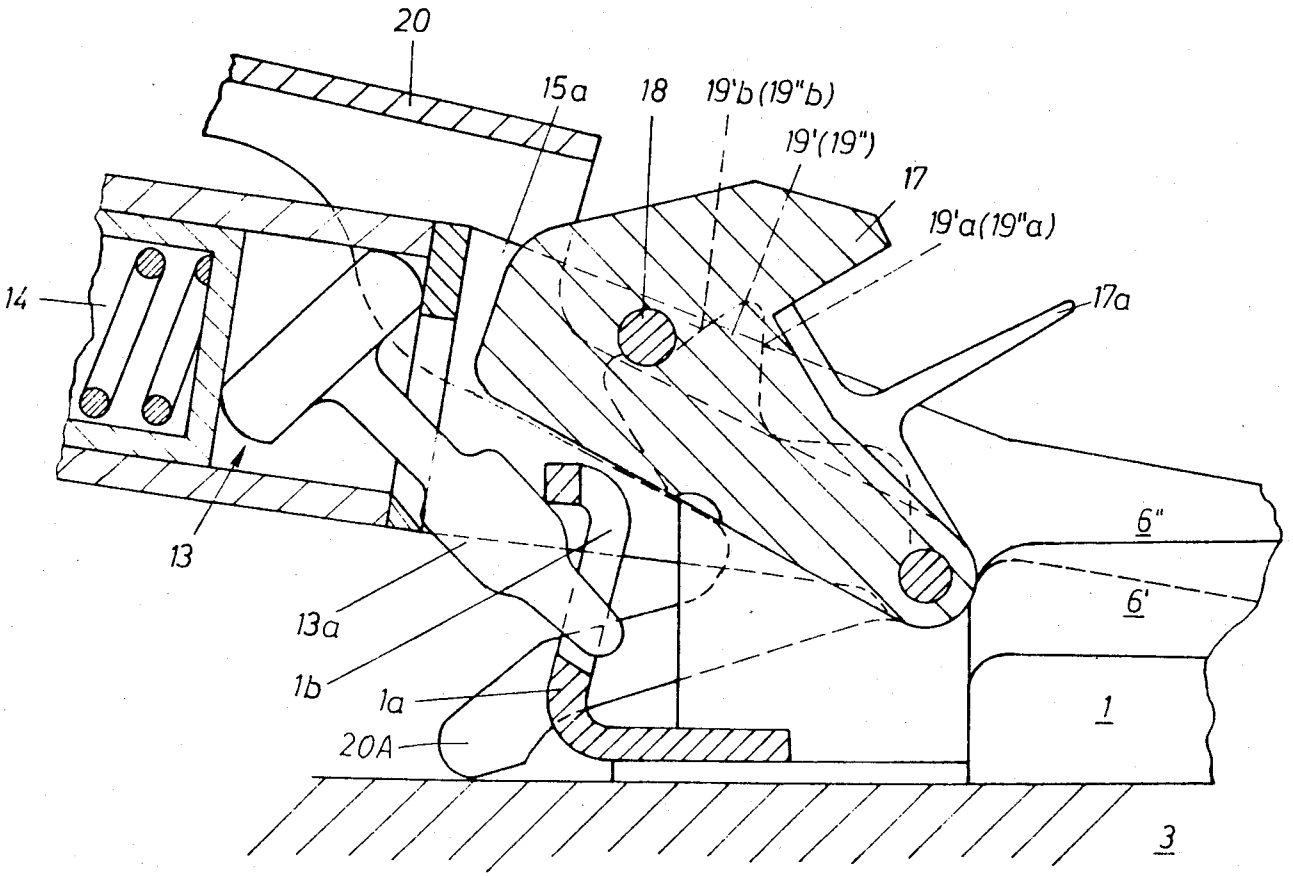

The embodiment according to FIG. 8 differs from the one according to FIGS. 1 to 7, primarily in the front jaw 11' being constructed in one piece with the part 6' of the sole plate 6. Furthermore, the part 6' grips with a hook-shaped extension 11'*a* under the base plate 1, so that a lifting off of the part 6' from the base plate 1 is impossible. This measure can suitably also be used in the first embodiment, as can be taken from FIG. 7.

In order to assure a release during the occurrence of lateral forces (occurring during twisting falls), the rear jaw, in the exemplary embodiment illustrated in FIG. 8, can in a conventional manner be swung both upwardly and also laterally outwardly. Such an embodiment is for example illustrated and described in Austrian Pat. No. 352 599.

Of course the invention is by no means to be limited to the exemplary embodiments which are illustrated in the drawings and are described above. Rather various modifications of the same are possible without departing from the scope of the invention. For example, embodiments in which between the underside of the weight arm of the release lever and the upper side of the ski a plate of low friction material can be provided and falls under the scope of the invention. Furthermore, the holding part can be made in one piece with the base plate and can be reinforced in the area of the control surfaces by an insert.

The embodiments of the invention in which an exclusive property or privilege is claimed are defined as follows:

1. In a release ski binding comprising a sole plate having thereon a rear jaw for a ski shoe, a central part of said sole plate being pivotal relative to said ski about a vertically upright axle and about a transversely extending axle arranged in front of said vertical axle, said sole plate being held in a skiing position by an elastic holding mechanism on said ski, said holding mechanism beng responsive to a swivel movement occurring between said sole plate and said ski and upon reaching of a predetermined angle of traverse, effects an opening of a release locking means on said rear jaw, the improvement comprising wherein said sole plate consists of first and second parts, said first part being pivotally supported for movement about a vertical axis of a sleeve and said second part being hingedly connected to said first part through said transverse axle, wherein said first part, at its front end and in a vertical longitudinal center plane thereof, has a bolt thereon which is vertically upright on the upper side of said ski, on which bolt is pivotally supported a front jaw, and wherein said front jaw is adapted to be received in a recess in a sole of said ski shoe and has, spaced from the vertical longitudinal center plane, two control bolts, each having vertically upright axes, said control bolts being guided on a cam surface formed by a transversely extending front narrow side surface of a base plate.

2. The binding according to claim 1, wherein a guide bar is secured to said ski adjacent a rear end of said base plate, said guide bar being Tshaped in cross section and is guided for limited movement in the longitudinal direction of said ski in an elongate slot in said base plate, and wherein fastening screws are provided for fastening said base plate to said ski adjacent the front thereof.

3. The binding according to claim 1, wherein said first part of said sole plate has a hook-shaped element adjacent the front end thereof received under said base plate.

4. The binding according to claim 1, wherein a generally bifurcate release lever functioning as a toggle lever is supported on axles supporting said rear jaw, which release lever has a lever arm part resting on the upper side of the ski.

5. In a release ski binding comprising a sole plate having thereon a rear jaw for a ski shoe, a central part of said sole plate being pivotal relative to said ski about a vertically upright axle and about a transversely extending axle arranged in front of said vertical axle, said sole plate being held in a skiing position by an elastic holding mechanism on said ski, said holding mechanism being responsive to a swivel movement occurring between said sole plate and said ski and upon reaching of a predetermined angle of traverse, effects an opening of a release locking means on said rear jaw, the improvement comprising wherein said sole plate consists of first and second parts, said first part being pivotally supported for movement about a vertical axis of a sleeve and said second part being hingedly connected to said first part through said transverse axle, wherein said second part of said sole plate is pivotal about said transverse axle and has an approximately U-shape defining a pair of legs, said legs substantially enclosing said first part along the two longitudinal sides thereof and totally enclosing same along the transversely extending side which faces the tail end of said ski, and wherein said second part has adjacent said rear jaw a pair of coaxial axles to which is hinged said rear jaw, said rear jaw being movable along two upwardly extending control paths of a cam surface arranged on said first part.

6. The binding according to claim 5, wherein said rear jaw has at least one transversely extending means resting on said control paths.

7. The binding according to claim 6, wherein each control path has a first surface which extends in an arc upwardly about said transverse axle and which defines an elastic limit for said binding, and a second surface which follows said first surface and which in the open position of said rear jaw extends in an arc about the axis of said coaxial axles, whereby the point of intersection of said first and second surfaces defines a release point for said binding.

8. The binding according to claim 7, wherein said second surface of each control path terminates in a projection which defines the angle of traverse of said rear jaw.

9. The binding according to claim 5, wherein a generally bifurcate release lever functioning as a toggle lever is supported on axles supporting said rear jaw, which release lever has a lever arm part resting on the upper side of the ski.

10. The binding according to claim 5, wherein a front jaw is rigidly secured to the first part of said sole plate.

11. The binding according to claim 5, wherein said first part, at its front end and in a vertical longitudinal center plane thereof, has a bolt thereon which is vertically upright on the upper side of said ski, on which bolt is pivotally supported a front jaw.

12. The binding according to claim 11, wherein said front jaw is adapted to be received in a recess in a sole of said ski shoe and has, spaced from the vertical longitudinal center plane, two control bolts, each having vertically upright axes, said control bolts being guided on a cam surface formed by a transversely extending front narrow side surface of a base plate.

13. The binding according to claim 5, wherein a guide bar is secured to said ski adjacent a rear end of said base plate, said guide bar being T-shaped in cross section and is guided for limited movement in the longitudinal direction of said ski in an elongate slot in said base plate, and wherein fastening screws are provided for fastening said base plate to said ski adjacent the front thereof.

* * * * *